US007063078B2

(12) United States Patent
Dees et al.

(10) Patent No.: US 7,063,078 B2
(45) Date of Patent: Jun. 20, 2006

(54) BREATHER ASSEMBLY FOR AN INTERNAL COMBUSTION ENGINE

(75) Inventors: Jesse Dees, Slinger, WI (US); Brian G. Thate, Brookfield, WI (US); Samir Mesanovic, Howards Grove, WI (US); Gregory Schmidt, Port Washington, WI (US)

(73) Assignee: Harley-Davidson Motor Company Group, Inc., Milwaukee, WI (US)

( * ) Notice: Subject to any disclaimer, the term of this patent is extended or adjusted under 35 U.S.C. 154(b) by 0 days.

(21) Appl. No.: 10/881,929

(22) Filed: Jun. 30, 2004

(65) Prior Publication Data

US 2006/0000458 A1 Jan. 5, 2006

(51) Int. Cl.
*F02M 25/06* (2006.01)

(52) U.S. Cl. ..... 123/572

(58) Field of Classification Search ..... 123/572–574
See application file for complete search history.

(56) References Cited

U.S. PATENT DOCUMENTS

| | | | |
|---|---|---|---|
| 3,270,727 | A | 9/1966 | Nance |
| 4,169,432 | A | 10/1979 | White |
| 4,438,734 | A | 3/1984 | Hayashi |
| 4,459,966 | A | 7/1984 | Sakano et al. |
| 4,549,520 | A | 10/1985 | Tamba et al. |
| 4,602,607 | A | 7/1986 | Balsley |
| 4,686,946 | A | 8/1987 | Umeda et al. |
| 4,711,224 | A | 12/1987 | Eckhardt |
| 4,721,075 | A | 1/1988 | Kasai |
| 4,911,120 | A | 3/1990 | Sumi |
| 4,920,930 | A | 5/1990 | Kakano et al. |
| 4,920,943 | A | 5/1990 | Castellari |
| 4,926,814 | A | 5/1990 | Bonde |
| 4,969,434 | A | 11/1990 | Nakagawa |
| 4,995,352 | A | 2/1991 | Machino |
| 5,027,784 | A | 7/1991 | Osawa et al. |
| 5,058,542 | A | 10/1991 | Grayson et al. |
| 5,067,449 | A | 11/1991 | Bonde |
| 5,205,243 | A | 4/1993 | Buchholz |

(Continued)

OTHER PUBLICATIONS

Harley-Davidson,Inc.; New Service Information for 1993 Models; Service Manual; At least as early as Jan. 1, 1992; 4 pages; Harley-Davidson, Inc-Technical Communications, Standards, and Graphics, Milwaukee, WI.

(Continued)

*Primary Examiner*—Marguerite McMahon
(74) *Attorney, Agent, or Firm*—Michael Best & Friedrich LLP

(57) ABSTRACT

A breather assembly for a motorcycle engine includes first and second substantially identical rocker supports that are each coupled to a respective cylinder head. Rocker covers are coupled to the rocker supports and cooperate therewith to define respective rocker chambers. Each rocker support defines a first breather passage and a second breather passage. A first breather assembly is coupled to the first breather passage of the first rocker support, and second breather assembly is coupled to the second breather passage of the second rocker support. A gasket member positioned between the rocker supports and the cylinder heads obstructs the unused breather passages of each rocker support. A sealing member is also provided that seals the interface between the rocker support and the rocker cover, and that also seals the interface between the breather assembly and the associated breather passage.

19 Claims, 7 Drawing Sheets

U.S. PATENT DOCUMENTS

| | | | | |
|---|---|---|---|---|
| 5,233,967 | A | 8/1993 | Peller | |
| 5,421,292 | A | 6/1995 | Hoffman et al. | |
| 5,474,035 | A | 12/1995 | Ming et al. | |
| 6,065,457 | A * | 5/2000 | Hoffmann et al. | 123/572 |
| 6,263,847 | B1 | 7/2001 | Hoffmann et al. | |
| 6,296,071 | B1 * | 10/2001 | Runte et al. | 180/219 |
| 6,345,613 | B1 | 2/2002 | Hoffmann et al. | |
| 6,672,294 | B1 * | 1/2004 | Pirone | 123/572 |
| 6,883,505 | B1 * | 4/2005 | Francis | 123/572 |

OTHER PUBLICATIONS

Harley-Davidson Motor Co.,Inc.; Parts Catalog XLH Models 1986; At least as early as Jan. 1, 1986; 5 pages; Milwaukee, WI.

* cited by examiner

BREATHER ASSEMBLY FOR AN INTERNAL COMBUSTION ENGINE

FIELD OF THE INVENTION

The invention relates to breather assemblies for internal combustion engines.

BACKGROUND OF THE INVENTION

During operation of a piston-cylinder type internal combustion engine, reciprocal movement of the pistons in the cylinders creates pressure pulses within the various chambers of the engine. For example, during an intake or expansion stroke of the piston, pressure within the crankcase of the engine generally increases, whereas during a compression or exhaust stroke of the piston, pressure within the crankcase of the engine generally decreases. The pressure pulses in the crankcase are communicated to other chambers within the engine, such as the rockerbox area, via breather passages, oil flow passageways, and the like. To reduce internal engine losses, often referred to as "pumping losses," many internal combustion engines utilize a breather system that operates to dissipate the pressure pulses within the crankcase, the rockerbox, and other chambers of the engine.

Movement of various internal engine components also creates an oil mist that is carried throughout the engine by the pressure pulses. Environmental concerns are such that it is preferred to separate as much of the oil mist as possible from the gasses that may be expelled from the engine through the breather system. Many breather systems remove the oil mist from the air by routing the internal engine gasses through screens, meshes, and various serpentine paths before discharging the gasses to the atmosphere. To further reduce emissions to the atmosphere, some breather systems route some or all of the gasses expelled from the breather system to the engine's air/fuel intake stream (e.g. to the airbox or to the intake manifold).

SUMMARY OF THE INVENTION

The present invention provides a breather assembly for a motorcycle engine including a crankcase, a first cylinder assembly extending from the crankcase in a first direction, and a second cylinder assembly extending from the crankcase in a second direction. Each cylinder assembly includes an engine cylinder, and a cylinder head. Each cylinder assembly also includes first and second substantially identical rocker supports that are each coupled to a respective one of the cylinder heads. Rocker covers are coupled to the rocker supports and cooperate to define respective rocker chambers. Each rocker support defines a first breather passage and a second breather passage. In the first cylinder assembly, the second breather passage is obstructed while the first breather passage communicates with a breather channel defined in the first cylinder head. In the second cylinder assembly, the first breather passage is obstructed while the second breather passage communicates with a breather channel defined in the second cylinder head. A first breather assembly is coupled to the first breather passage of the first rocker support and provides substantially one-way fluid communication between the first rocker chamber and the first cylinder head. A second breather assembly is coupled to the second breather passage of the second rocker support and provides substantially one-way fluid communication between the second rocker chamber and the second cylinder head. The configuration is such that the rocker supports and rocker covers for the first and second cylinder assemblies are substantially identical, while still allowing the breather assemblies to be positioned differently within the respective rocker chambers.

In other aspects, the rocker box assembly also includes a sealing member positioned between the upper and lower surfaces of the base portion and the cover portion. The sealing member includes an outer first portion that engages the upper surface and the lower surface to substantially seal the interface between the base portion and the cover portion. The sealing member also includes a second portion that engages an outlet of the breather assembly and the breather passage of the base portion to seal the breather passage from the rocker chamber.

Various features and advantages of the invention will become apparent to those skilled in the art upon review of the following detailed description, claims, and drawings.

Figure 1:
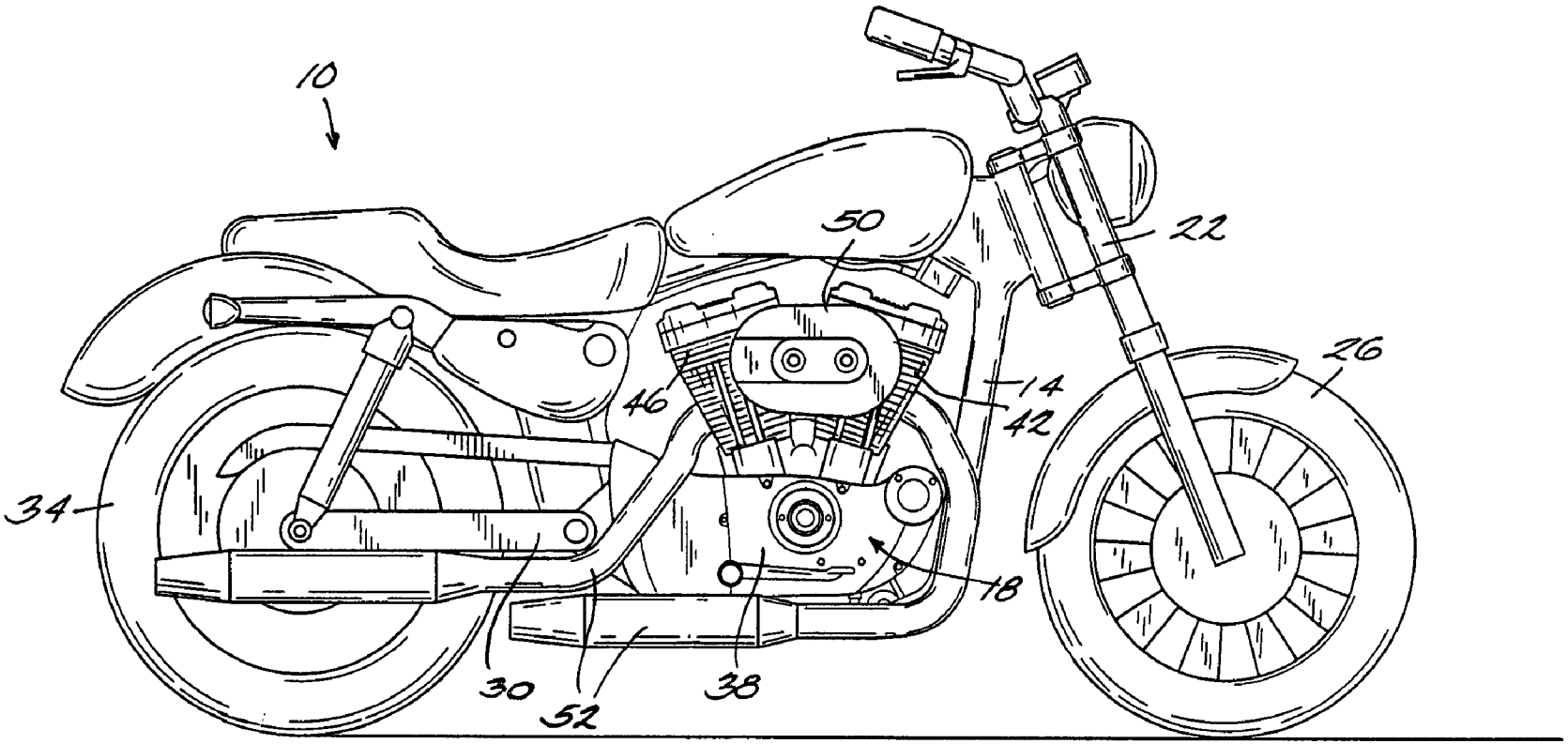
FIG. 1 is a side view of a motorcycle embodying the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting.

DETAILED DESCRIPTION

The motorcycle 10 in FIG. 1 includes a frame 14, and an engine assembly 18 coupled to the frame 14. A steering assembly 22 pivotally couples a front wheel 26 to a forward portion of the frame 14, and a swingarm 30 couples a rear wheel 34 to a rearward portion of the frame 14. The engine assembly 18 includes a crankcase 38, a first cylinder assembly 42 that extends upwardly and forwardly from the crankcase 38, and a second cylinder assembly 46 that extends upwardly and rearwardly from the crankcase 38. The first and second cylinder assemblies 42, 46 are arranged with respect to one another to define a "V-twin" engine configuration. An air cleaner assembly 50 is coupled to at least one of the first and second cylinder assemblies 42, 46 and communicates with an air/fuel mixing device (not shown) such as a carburetor or fuel injection system. An exhaust assembly 52 is coupled to the cylinder assemblies 42, 46 and discharges engine exhaust to the atmosphere.

Figure 2:
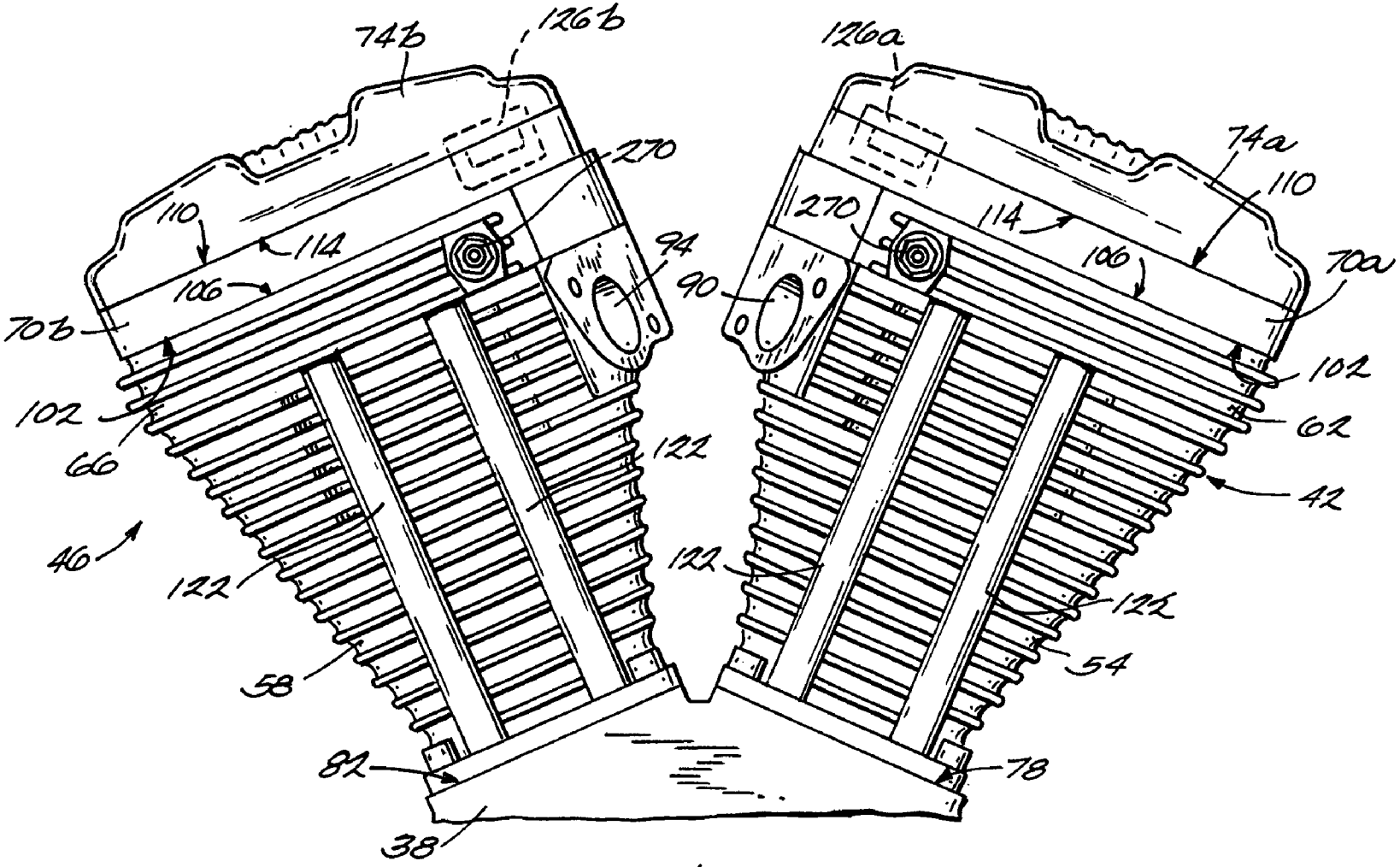
FIG. 2 is an enlarged view of the engine cylinder assemblies of the motorcycle illustrated in FIG. 1

Referring to FIG. 2, each cylinder assembly 42, 46 includes an engine cylinder 54, 58, and a cylinder head 62, 66 coupled to a distal end of a respective engine cylinder 54, 58. Each engine cylinder 54, 58 is coupled to a respective mounting surface 78, 82 of the crankcase 38. Each cylinder assembly also includes a rocker base 70*a*, 70*b* coupled to a respective cylinder head 62, 66, and a rocker cover 74*a*, 74*b* coupled to a respective rocker base 70*a*, 70*b*. As discussed further below, the cylinder heads 62, 66, the rocker bases 70*a*, 70*b*, and rocker covers 74*a*, 74*b* are configured such that the rocker bases 70*a*, 70*b* and the rocker covers 74*a*, 74*b* are substantially identical. Each cylinder head 62, 66 defines an intake port 90, 94 and cooperates with a respective engine cylinder 54, 58 to define a combustion chamber (not shown), which receives the air/fuel mixture from the intake ports 90, 94.

Figure 3:
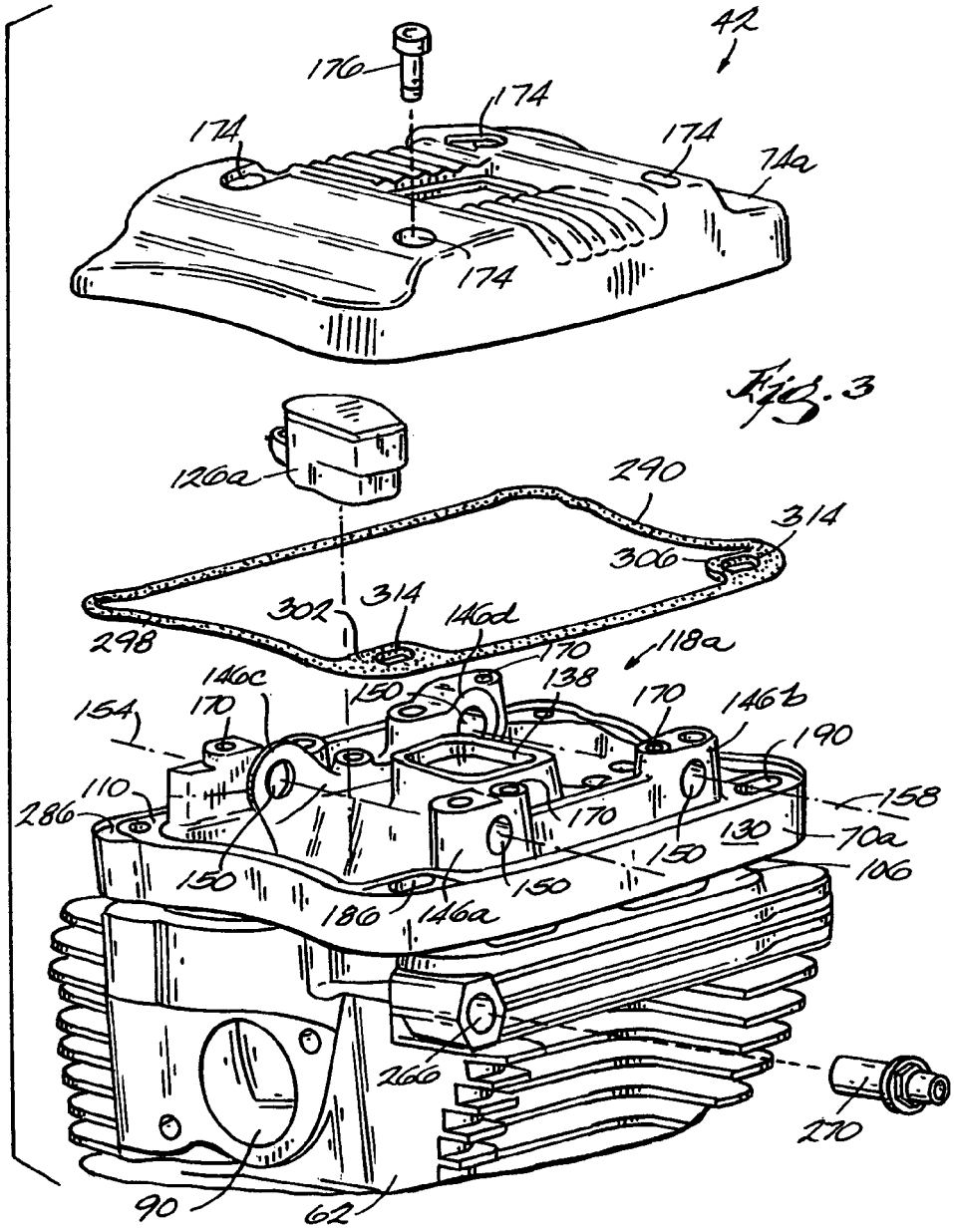
FIG. 3 is an exploded view of one of the engine cylinder assemblies illustrated in FIG. 2.

Referring to FIG. 3, a bottom surface 102 of each rocker base 70*a*, 70*b* engages a top surface 106 of each cylinder head 62, 66, and an upper surface 110 of each rocker base 70*a*, 70*b* engages a lower surface 114 of each rocker cover 74*a*, 74*b*. The rocker bases 70*a*, 70*b* cooperate with their respective rocker covers 74*a*, 74*b* to define first and second rocker chambers 118*a*, 118*b*, respectively. Pushrod tubes 122 (FIG. 2) extend between the crankcase 38 and the cylinder heads 62, 66. Each rocker chamber 118*a*, 118*b* houses a valve actuating mechanism (not shown) which may be of conventional construction and may include, among other things, pushrods, rockers, valves, and valve springs. In addition, the first rocker chamber 118*a* houses a first breather assembly 126*a*, and the second rocker chamber houses a second breather assembly 126*b*.

Although only the first cylinder assembly 42 is discussed further below, it should be appreciated that, except as noted, the second cylinder assembly 46 is configured similarly to the first cylinder assembly 42.

Figure 4:
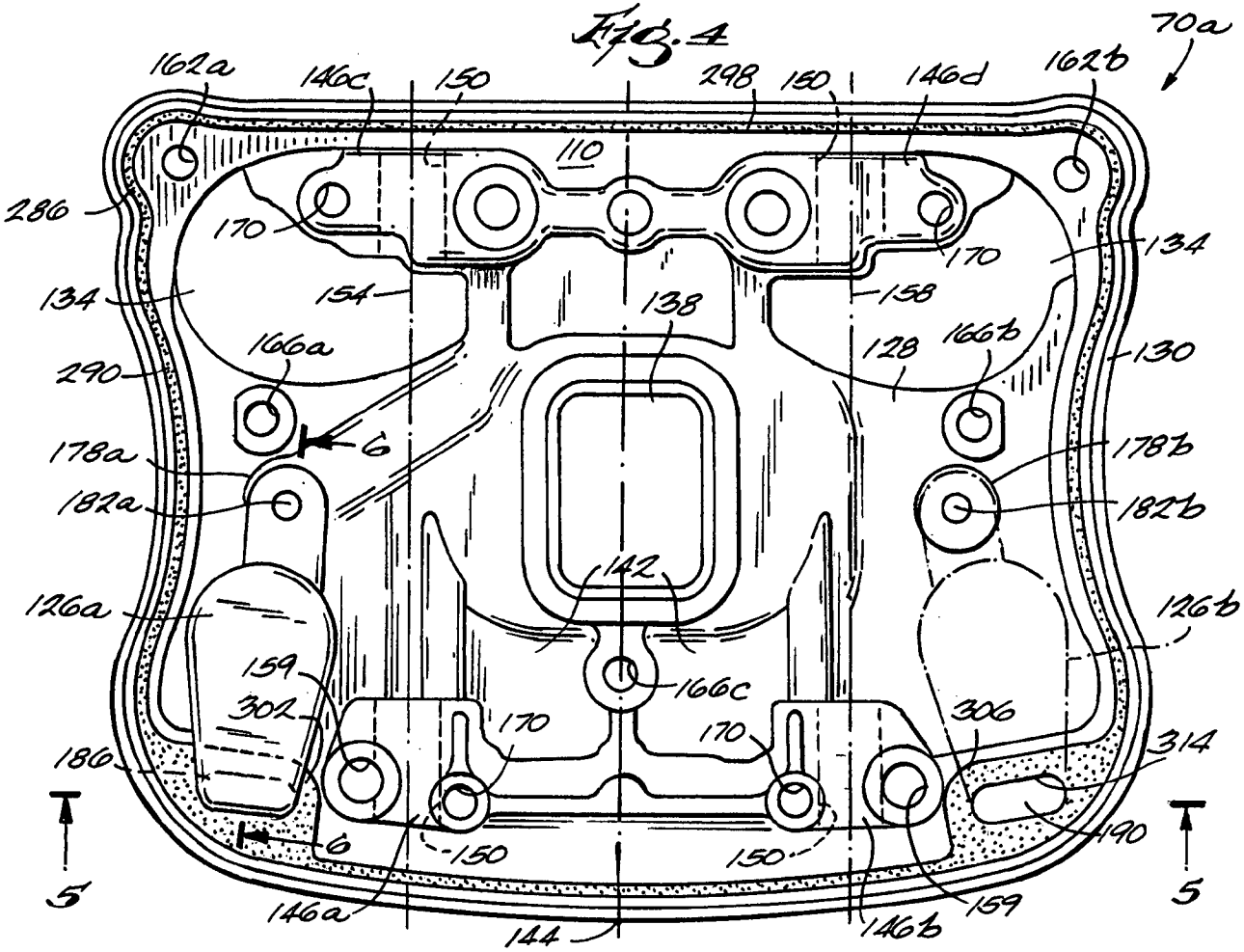
FIG. 4 is a top view of a rockerbox portion of the engine cylinder assembly illustrated in FIG. 3.
Figure 5:
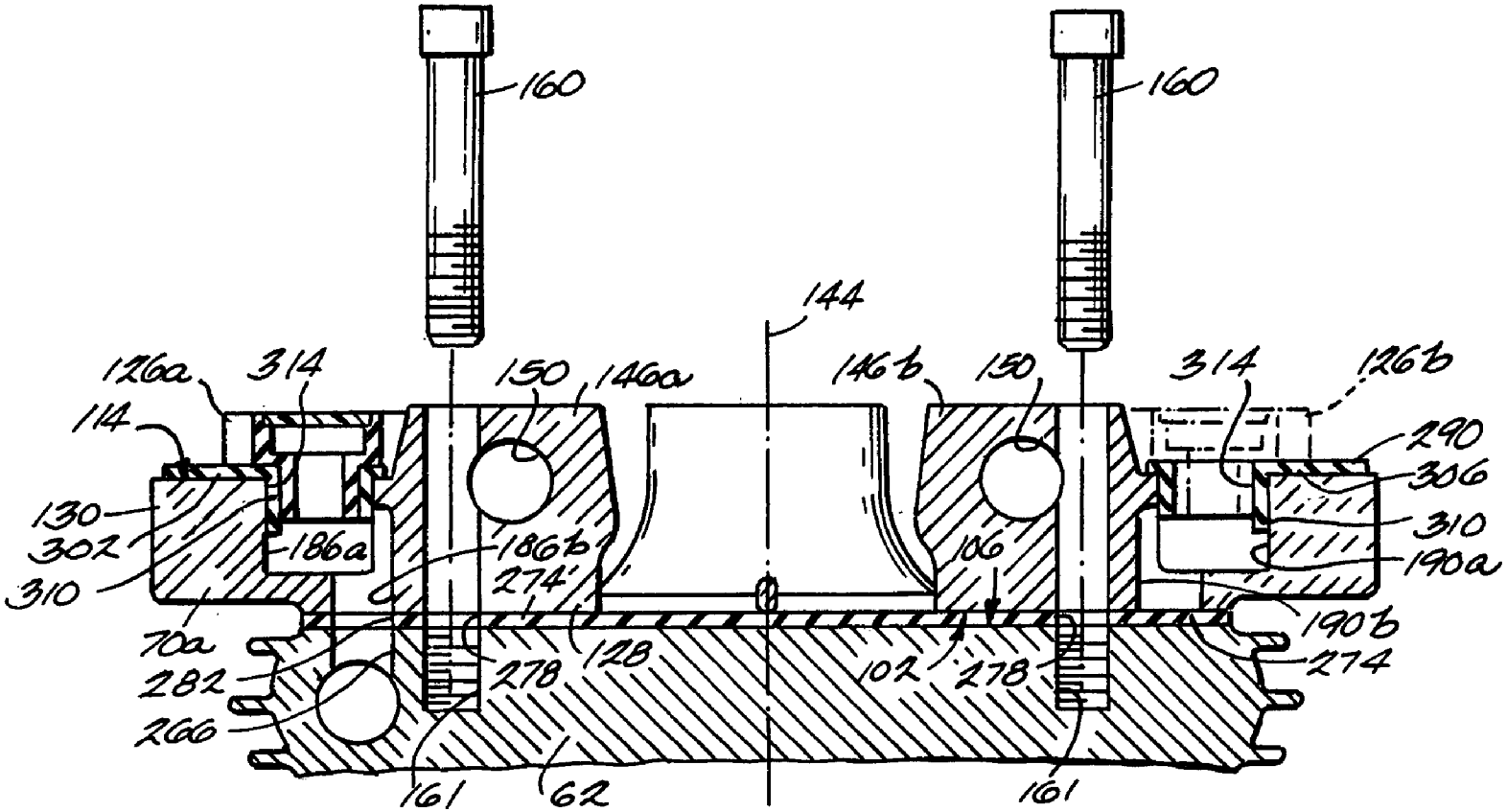
FIG. 5 is a section view taken along line 5—5 of FIG. 4.

Referring to FIGS. 4 and 5, the rocker base 70*a* includes a lower wall 128 that defines the bottom surface 102, and a perimeter wall 130 that extends upwardly from the bottom surface 102 and defines the upper surface 110. The lower wall 128 defines a pair of valve openings 134 through which engine valves (not shown) extend. The lower wall 128 also defines a central opening 138 that affords access to a spark plug (not shown), and pushrod openings 142 through which the pushrods extend. A central plane 144 extends through the central opening 138, between the pushrod tube openings, and is substantially normal to the bottom surface 102.

Four rocker supports 146*a*, 146*b*, 146*c*, 146*d* extend upwardly from the lower wall 102 and beyond the upper surface 110. Each rocker support 146*a*, 146*b*, 146*c*, 146*d* defines a rocker support bore 150. The rocker support bores 150 of one pair of rocker supports 146*a*, 146*c* are substantially aligned and define a first axis 154 on one side of the plane 144. Rocker support bores 150 of the other pair of rocker supports 146*b*, 146*d* are also substantially aligned and define a second axis 158 on an opposite side of the plane 144. As illustrated, the first and second axes 154, 158 are substantially parallel to one another, and are also substantially parallel to the plane 144. The rocker support bores 138 support rocker shafts (not shown), upon which the rockers pivot during engine operation.

Each rocker support 146*a*, 146*b*, 146*c*, 146*d* also defines a mounting aperture 159 that is substantially normal to and extends through the bottom surface 102. Fasteners 160 (FIG. 5) are inserted into the mounting apertures 159 and are threaded into bores 161 (FIG. 5) defined in the cylinder head 62 to couple the rocker base 70*a* to the cylinder head. The mounting apertures 159 of the rocker supports 146*a*, 146*b* intersect the rocker support bores 150 such that the fasteners 160 engage cylindrical recesses in the rocker support shafts. Engagement of the fasteners 160 and the rocker support shafts substantially prevents rotation of the rocker support shafts in the rocker support bores.

The perimeter wall 130 defines a first pair of mounting apertures 162*a*, 162*b* that are positioned near corners of the rocker base 70*a* adjacent the valve openings 134, and that extend through the bottom surface 102. The mounting apertures 162*a*, 162*b* align with corresponding threaded openings (not shown) defined by the cylinder head 62 and that threaded fasteners (not shown) are inserted through the mounting apertures 162 and into the threaded openings. The lower wall 128 defines additional mounting apertures 166*a*, 166*b*, 166*c* that also extend through the bottom surface 102, are aligned with threaded openings in the cylinder head 62, and that receive threaded fasteners to further couple the rocker base 70*a* to the cylinder head 62. The first two additional apertures 166*a*, 166*b* are positioned inwardly from the perimeter wall 130 and adjacent to respective valve openings 134. The third additional aperture 166*c* is positioned between the pushrod openings 142 and is substantially aligned with the plane 144.

Each rocker support 146*a*, 146*b*, 146*c*, 146*d* defines a threaded blind bore 170 that extends substantially normal to the rocker support bores 150 and opens toward the rocker cover 74*a*. The rocker cover 74*a* defines a set of corresponding cover mounting apertures 174 that align with the threaded bores 170. Threaded fasteners 176 (FIG. 3) are inserted through the mounting apertures 174 and into the threaded bores 170 to couple the rocker cover 74*a* to the rocker base 70*a*.

The lower wall 128 defines a first breather mounting boss 178*a*, and a second breather mounting boss 178*b*. Each mounting boss 178*a*, 178*b* defines a threaded blind bore 182*a*, 182*b* that extends normal to the bottom surface 102 and opens toward the rocker cover 74*a*. The perimeter wall 130 defines a first breather passage 186 including a first, generally oblong passage portion 186*a* (FIG. 5) that extends through the upper surface 110, and a second, generally cylindrical portion 186*b* (FIG. 5) that is offset from the first portion 186*a* and extends through the bottom surface 102. The perimeter wall 130 also defines a second breather passage 190, which also includes a first portion 190*a* (FIG. 5) that extends through the upper surface 110, and a second portion 190*b* (FIG. 5) that extends through the bottom surface 102. The first and second breather passages 186, 190 are similarly configured and are positioned substantially opposite one another with respect to the plane 144.

Figure 6:
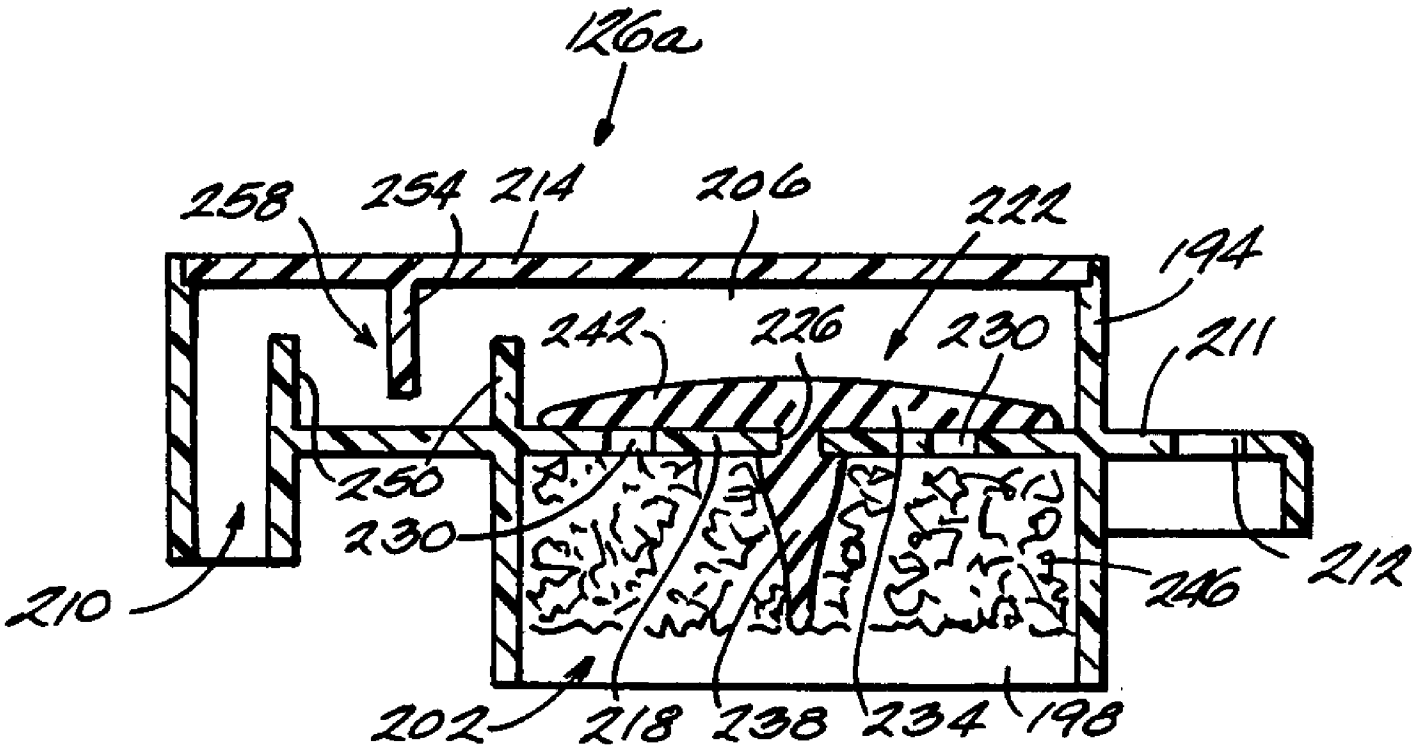
FIG. 6 is a section view taken along line 6—6 of FIG. 4.
Figure 7:
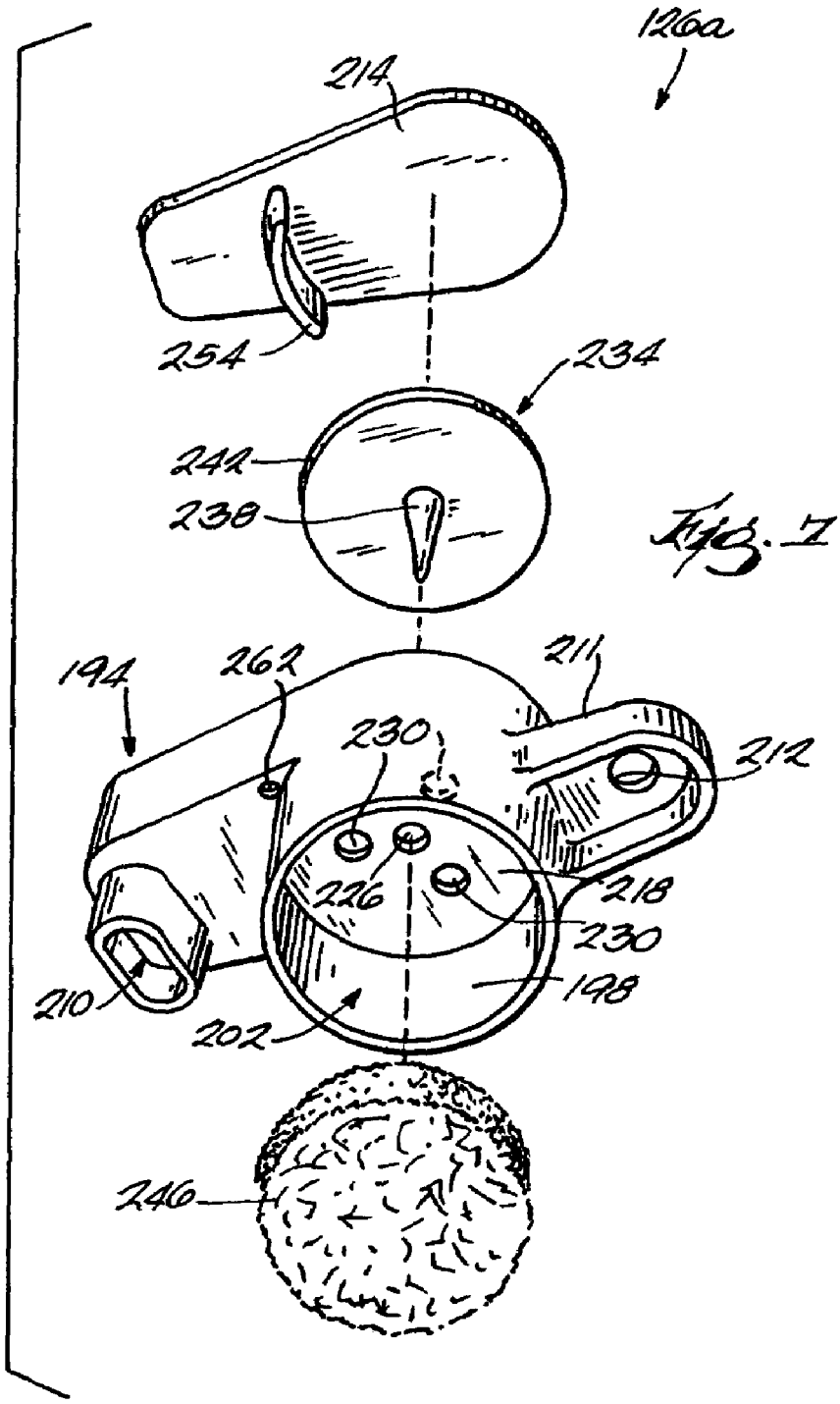
FIG. 7 is an exploded view of a breather assembly of the engine cylinder assembly illustrated in FIG. 3.

FIGS. 6 and 7 illustrate the first breather assembly 126*a*. Although only the first breather assembly 126*a* is shown and described in detail, it is noted that the second breather assembly 126*b* is configured similarly to the first breather assembly 126*a*, and in some constructions may be identical to the first breather assembly 126*a*. The breather assembly 126*a* includes a body portion 194 that defines a first chamber 198 having a breather inlet 202, and a second chamber 206 having a breather outlet 210. The body portion also includes a mounting tab 211 that defines a mounting aperture 212. A cover portion 214 engages the body portion 194 and at least partially overlies the second chamber 206. A dividing wall 218 defines a boundary between the first and second chambers 198, 206 and comprises a portion of a check valve assembly 222 that is operable to provide substantially one-way flow from the first chamber 198 to the second chamber 206.

The check valve assembly 222 includes a central aperture 226 and a plurality of vent apertures 230 that are defined by the dividing wall 218. A resilient valve member 234 includes a central projection 238 that is received by the central aperture 226 and extends into the first chamber 198. The valve member 234 also includes a flapper portion 242 that is positioned in the second chamber 206 and overlies the vent apertures 230. A filter member 246 comprised of a porous, sponge-like material is positioned in the first chamber 198 between the inlet 202 and the dividing wall 218.

The body portion 194 includes a pair of deflector walls 250 that extend into the second chamber 206 between the valve assembly 222 and the outlet 210. The cover portion 214 includes a deflector tab 254 that extends into the second chamber between the deflector walls 250. The deflector walls 250 and the deflector tab 254 cooperate to define a serpentine path 258 between the valve assembly 222 and the outlet 210. A small aperture 262 (FIG. 7) is defined in the body and is positioned between the deflector walls 250 to allow oil to drain from the space between the deflector walls 250.

During engine operation, oil-laden engine vapors circulate through the rocker chamber 118*a*. When pressure in the rocker chamber 118*a* increases, the flapper portion 242 of the valve member 234 is urged away from the vent apertures 230 to allow the vapors to flow through the breather assembly 126*a*. The oil-laden vapors pass through the inlet 202 of the breather assembly 126*a* and enter the filter member 246. At least some of the oil mist in the vapors collects on the filter member 246 in liquid form, and drips back into the rocker chamber 118*a*. The vapors then pass through the check valve assembly 222 and enter the serpentine path 258. As the vapors pass over the deflector walls 250 and the deflector tab 254, additional oil mist impinges on the walls 250 and the tab 254 and collects the space between the deflector walls 250 in liquid form. This liquid oil drains back into the rocker chamber 118*a* by way of the small aperture 262. The vapors then exit the breather assembly 126*a* through the outlet 210.

Referring again to FIGS. 4 and 5, vapors exiting the breather outlet 210 enter the first portion 186*a* of the first breather passage 186, pass through the second portion 186*b*, and flow into a breather channel 266 defined by the cylinder head 62. The vapors exit the cylinder head 62 through a hollow breather bolt 270 that is received by the breather channel 266. The breather bolt 270 provides a restricting orifice that dampens pressure pulses or fluctuations within the breather assembly 126*a* to help prevent or reduce flutter of the valve member 234, and to separate additional amounts of liquid oil from the engine vapors. The vapors pass through the breather bolt 270 and flow through a vapor conduit (not shown) to the air cleaner assembly 50, where the vapors are introduced into the engine's air/fuel intake flow path. Engine vapors are therefore substantially prevented from being discharged directly to the atmosphere, and are instead routed through the engine combustion chamber and discharged through the engine exhaust assembly 52.

FIGS. 4 and 5 illustrate the first breather assembly 126*a* coupled to the first rocker base 70*a*. As shown, the mounting aperture 212 of the body portion 194 aligns with the first breather mounting boss 178*a* and is coupled thereto with a threaded fastener (not shown). The breather outlet 210 is received by the first portion 186*a* of the first breather passage 186 in the cylinder head 62. This configuration (e.g. with the first breather assembly outlet 210 in communication with the first breather passage 186) is utilized for the rocker base 70*a* that is coupled to the first, forward cylinder assembly 42 (see FIG. 2). As shown in phantom, the outlet 210 of the second breather assembly 126*b* can be positioned in the second breather passage 190, and the mounting aperture 212 can be aligned with the second breather mounting boss 178*b*. This configuration is utilized for the rocker base 70*b* (which, as discussed above is substantially identical to the rocker base 70*a*) that is coupled to the second, rearward cylinder assembly 46 (see FIG. 2).

A gasket member 274 is positioned between the top surface 106 of the cylinder head 62 and the bottom surface 102 of the rocker base 70*a* (see FIG. 5). The gasket member 274 defines openings 278 through which the fasteners 160 extend. The gasket member 274 also defines a vapor orifice 282 through which engine vapors may pass from the second portion 186*b* of the first breather passage 186 to the breather channel 266 of the cylinder head 62. Note however that the gasket member 274 does not include a vapor orifice 282 in the vicinity of the second breather passage 190, nor does the cylinder head 62 include a corresponding breather channel 266. The gasket member 274 and the cylinder head 62 therefore obstruct the second breather passage 190, which is not utilized when the rocker base 70*a* is coupled to the first, forward cylinder assembly 42. It should be appreciated that for the second, rearward cylinder assembly 46, in which the second breather assembly 126*b* is utilized, an alternate gasket member is provided that obstructs the first breather passage 186 of the rocker base 70*b*, and that defines an orifice in the vicinity of the second breather passage 190 of the rocker base 70*b*. Also, the second cylinder head 66 includes a breather channel 266 that is aligned with the second breather passage 190, and is substantially continuous in the vicinity of the first breather passage 186. Thus, in the second cylinder assembly 46, the second breather passage 190 communicates with the cylinder head 66, while the first breather passage 186 is obstructed.

The perimeter wall 130 defines a gasket-receiving channel 286 that is recessed with respect to the upper surface 110, and which receives a rocker cover gasket 290. The rocker cover 74*a* defines a similar channel (not shown) that is recessed with respect to the lower surface 114 and that also receives the cover gasket 290 when the rocker cover 74*a* is coupled to the rocker base 70*a*. The cover gasket 290 substantially seals the rocker chamber 118 at the interface defined between the upper surface 110 and the lower surface 114.

The cover gasket 290 defines a substantially rectangular endless loop and includes an outer first portion 298 that defines the outer perimeter of the cover gasket 290. The cover gasket 290 also includes second and third portions 302, 306 that extend inwardly from the first portion 298 into the rocker chamber 118*a*. The second portion 302 overlies a portion of the perimeter wall 130 surrounding the first breather passage 186, and the third portion 302 overlies a portion of the perimeter wall 130 surrounding the second breather passage 190. The second and third portions 302, 306 each include a flange portion 310 that defines an opening 314. The flange portions 310 are received by, and extend into the first and second breather passages 186, 190, respectively.

Like the rocker bases 70*a*, 70*b*, the cover gasket 290 utilized for the first cylinder assembly 42 is substantially identical to the cover gasket 290 utilized for the second cylinder assembly 46. As such, for the first cylinder assembly 42, the opening 314 in the second portion 302 of the cover gasket 290 receives the breather outlet 210 of the first breather assembly 126*a*, while the opening 314 in the third portion 306 remains unoccupied. For the second cylinder assembly 46, the opening 314 in the third portion 306 of the cover gasket 290 receives the breather outlet 210 of the second breather assembly 126*b*, while the opening 314 in the second portion 302 remains unoccupied. In addition to sealing the interface between the rocker bases 70*a*, 70*b* and the rocker covers 74*a*, 74*b*, the cover gaskets 290 in the first and second cylinder assemblies 42, 46 also seal the interfaces between the breather outlets 210 and the first and second breather passages 186, 190, respectively.

Various features of the invention are set forth in the following claims.

We claim:

1. A rocker box assembly adapted to be coupled to a cylinder head of a motorcycle engine, the rocker box assembly comprising:

a base portion coupled to the cylinder head, the base portion defining an upper surface and a breather passage that extends through the upper surface and communicates with the cylinder head;

a cover portion at least partially overlying the base portion and cooperating therewith to at least partially define a rocker chamber, the cover portion including a lower surface facing the upper surface of the base portion, the lower surface and the upper surface defining an interface;

a breather assembly positioned within the rocker chamber, the breather assembly defining an inlet communicating with the rocker chamber and an outlet communicating with the breather passage; and a sealing member including a first portion engaging the upper surface and the lower surface to substantially seal the interface, and a second portion integral with the first portion and engaging the outlet and the breather passage to substantially seal the breather passage from the rocker chamber, wherein the second portion of the sealing member includes a flange portion that receives the outlet and that extends into the breather passage.

2. The rocker box assembly of claim 1, wherein the breather assembly includes a check valve affording flow from the inlet toward the outlet while substantially preventing flow from the outlet toward the inlet.

3. The rocker box assembly of claim 2, wherein the breather assembly defines a first chamber between the check valve and the inlet, and a second chamber between the check valve and the outlet.

4. The rocker box assembly of claim 1, wherein the outlet is received by the breather passage.

5. The rocker box assembly of claim 1, wherein the interface defines a perimeter of the rocker chamber, and wherein the first portion of the sealing member defines an endless loop that substantially seals the interface along the perimeter.

6. The rocker box assembly of claim 1, wherein the second portion of the sealing member extends inwardly into the rocker chamber from the first portion.

7. The rocker box assembly of claim 1, wherein the base portion defines a second breather passage spaced from the first breather passage and the sealing member defines a third portion engaging the second breather passage, and wherein the breather assembly is selectively positioned for communication with only one of the breather passages.

8. A motorcycle engine comprising:

a crankcase;

a first cylinder assembly extending from the crankcase in a first direction;

a second cylinder assembly extending from the crankcase in a second direction;

first and second substantially identical rocker bases, each rocker base coupled to a respective one of the cylinder assemblies and defining a first breather passage and a second breather passage;

a first breather assembly coupled to the first rocker base and communicating with the first cylinder assembly through the first breather passage of the first rocker base;

a second breather assembly coupled to the second rocker base and communicating with the second cylinder assembly through the second breather passage of the second rocker base, wherein the second breather passage of the first rocker base and the first breather passage of the second rocker base are obstructed.

9. The motorcycle engine of claim 8, further comprising a first gasket member between the first cylinder assembly and the first rocker base and a second gasket member between the second cylinder assembly and the second rocker base, the first gasket member defining an aperture affording communication between the first breather passage and the first cylinder assembly, and the second gasket member defining an aperture affording communication between the second breather passage and the second cylinder assembly.

10. The motorcycle engine of claim 9, wherein the first gasket member obstructs the second breather passage of the first rocker base, and the second gasket member obstructs the first breather passage of the second rocker base.

11. The motorcycle engine of claim 8, wherein the first rocker base at least partially defines a first rocker chamber and the second rocker base at least partially defines a second rocker chamber, and wherein the first and second breather assemblies are each positioned within a respective one of the rocker chambers.

12. The motorcycle engine of claim 11, wherein the first cylinder assembly extends forwardly and upwardly from the crankcase, and the second cylinder assembly extends rearwardly and upwardly from the crankcase, and wherein the first breather assembly is positioned rearwardly within the first rocker chamber and the second breather assembly is positioned forwardly within the second rocker chamber.

13. The motorcycle engine of claim 8, wherein each breather assembly includes an inlet, an outlet, a filtering member, and a check valve, and wherein the outlet of each breather assembly communicates with a respective one of the breather passages.

14. The motorcycle engine of claim 8, further comprising an intake assembly, wherein the first cylinder assembly defines a first breather channel and the second cylinder assembly defines a second breather channel, and wherein the first breather passage of the first rocker base communicates with the intake assembly through the first breather channel, and wherein the second breather passage of the second rocker base communicates with the intake assembly through the second breather channel.

15. A rocker base for a motorcycle engine, the engine including a crankcase and at least first and second cylinder assemblies, the rocker base comprising:

a lower wall at least partially defining a rocker chamber in communication with the crankcase;

a plurality of rocker supports extending from the lower wall and defining rocker support bores;

a first breather passage defining a first inlet in communication with the rocker chamber and a first outlet that opens through the lower wall;

a second breather passage spaced from the first breather passage and defining a second inlet in communication with the rocker chamber and a second outlet that opens through the lower wall, each outlet adapted for communication with a selected one of the cylinder assemblies, wherein when the rocker base is coupled to the first cylinder assembly, only the first of the outlets is in communication with the first cylinder assembly, and when the rocker base is coupled to the second cylinder assembly, only the second of the outlets is in communication with the second cylinder assembly.

16. The rocker base of claim 15, wherein when the rocker base is coupled to the first cylinder assembly the first inlet is in communication with a first breather assembly, and wherein when the rocker base is coupled to the second cylinder assembly the second inlet is in communication with a second breather assembly.

17. The rocker base of claim 15, wherein each cylinder assembly defines a breather channel, wherein when the rocker base is coupled to the first cylinder assembly, the first outlet is in communication with the breather channel of the first cylinder assembly and the second outlet is obstructed, and wherein when the rocker base is coupled to the second cylinder assembly, the second outlet is in communication with the breather channel of the second cylinder assembly and the first outlet is obstructed.

18. The rocker base of claim 15, wherein the lower wall defines a first plane and the rocker support bores define at least one axis, wherein the first breather passage is on one side of a second plane that is substantially normal to the first plane and substantially parallel to the at least one axis, and wherein the second breather passage is on an opposite side of the second plane.

19. The rocker base of claim 15, further comprising a sealing member defining an endless loop and including a first portion that extends along a perimeter of the base, a second portion depending from the first portion and engaging the first inlet, and a third portion depending from the first portion and engaging the second inlet.

* * * * *